US006071202A

United States Patent [19]

Densberger et al.

[11] Patent Number: 6,071,202

[45] Date of Patent: Jun. 6, 2000

[54] GOLF SWING TRAINING METHOD

[76] Inventors: John A. Densberger; Derek E. Decker, both of 1111 Sherry Way, Livermore, Calif. 94550

[21] Appl. No.: 08/931,050

[22] Filed: Sep. 16, 1997

Related U.S. Application Data

[60] Provisional application No. 60/035,556, Jan. 14, 1997.

[51] Int. Cl.[7] ..... A63B 69/36

[52] U.S. Cl. ..... 473/409; 473/220; 473/260; 362/259

[58] Field of Search ..... 473/220, 222, 473/409, 260, 257; 362/259

[56] References Cited

U.S. PATENT DOCUMENTS 5,207,429 5/1993 Walmsley et al. ..... 473/220

5,527,041 6/1996 Terry et al. ..... 473/220

*Primary Examiner*—George J. Marlo

[57] ABSTRACT

A method for practicing a golf swing wherein a laser swing aid is used for defining a swing path for a club head and for aligning a club head of a golf club with a ball along a target path. The swing aid includes a body containing a power source coupled to a laser source coupled to an optics system. The optics system is arranged to produce a light beam in a plane. The body of the swing aid is positioned a distance apart from and separate from the club head and ball. The plane of the beam formed by the swing aid is positioned to produce a line of light aligned with the target path, the club head, and the ball. The line of light is formed and positioned to be visible across the club head and the ball along the target path and throughout at least a portion of a desired swing path.

5 Claims, 4 Drawing Sheets

GOLF SWING TRAINING METHOD

This application is based on U.S. Provisional Application Ser. No. 60/035,556, filed on Jan. 14, 1997, which disclosure is incorporated herein by reference for all purposes.

BACKGROUND OF THE INVENTION

The present invention relates to the game of golf. More specifically, the present invention relates to golf swing and training aids.

Golf courses generally have 18 holes spread over a landscaped area that customarily includes a number of hazards-water, rough, sand traps (also known as bunkers), and trees-that are designed to make the game more difficult. Difficulty is also increased by the varying distances among holes. Play on each hole is begun at the tee area, from which players "tee off" and "drive" the ball into the fairway or onto the green. At the end of the hole-which can vary in length from about 100 to 600 yards-is the putting green, which surrounds the actual hole, or "cup" into which the ball must usually be putted to complete the hole. Saint Andrews in Scotland, Augusta National in Georgia (site of the annual Masters tournament) and Pebble Beach in California have some of the most famous and difficult courses.

It is recognized that repetitive practice is essential to improving a golfer's game. In part, the repetitive practice is necessary to develop consistent swings for each of the clubs used on the course. A golfer who has established good habits and swing patterns for each club will post better scores in play, despite the varying conditions and hazards encountered on different courses.

This need for consistent practice to develop a consistent swing pattern is important for all clubs, but is most apparent for the putter. In the putting segment of the game of golf, the objective is to direct the ball across the putting green until it comes to rest in the hole or cup. The putting green is a smooth and closely cut grassy area surrounding the hole. An accurately hit golf ball will travel along a path to the hole. In the case where the path between the ball and hole contains a slope to one side or the other, the golfer will try to determine the proper target direction which will allow the ball (once struck) to follow a curved path to the hole.

Although the putting green is usually conditioned to provide an optimum surface over which to putt, a golfer's inability to accurately and consistently aim the ball and smoothly swing the putter can be a major source of undesirable "strokes" on the golfer's scorecard. When putting, it is very important that the face of the putter be placed at exactly a right angle in line to the target direction at the moment when the putter impacts the ball. Alignment of the putter adjacent to the ball in this manner is difficult when the ball rests even a short distance from the hole, since the golfer is usually unable to see the ball, club head, and target simultaneously. This problem also exists when using other types of golf clubs.

In general, a golfer attempts to ensure that the club head alignment and motion are co-linear with the intended direction at the exact point of impact with the ball. Ideally, the club head is maintained in alignment with the ball throughout the golfer's backstroke. This correct stroke will be referred to herein as a "pendulum swing". An example of a correct pendulum swing is shown in FIG. 2B, where a club head 32 is aligned to strike a ball 36 along a target path 50. During each position of proper pendulum swing, club head 32 is consistently aligned square with ball 36. A golfer capable of consistently repeating this stroke will putt the ball with more consistency and accuracy. Golfers who have not mastered pendulum swings tend to hit the ball with less consistency and accuracy. An example of an improper swing is shown in FIG. 2A, where club head 32 is shown during a backstroke. In this swing, the golfer brings club head 32 to the ball in an arc 52. At the point of impact with the ball, club head 32 may impart some spin to the ball, or may otherwise direct the ball off of the intended target line. It is desirable to provide a device and method which will permit a golfer to perfect the pendulum swing, thereby improving the golfer's score and satisfaction.

Part of the appeal of the game of golf is the difficulty of mastering these strokes. Weekend golfers, who do not have the luxury of constant practice, have a difficult time consistently putting the ball accurately. Consistency can only be achieved by constant and repeated training so that the golfer can replicate the correct club head alignment and motion as needed during play. A number of patents have attempted to provide improvements in a golf club that would help a golfer achieve consistency in club head alignment and motion.

One beneficial approach is shown in U.S. Pat. No. 5,640,777 to Densberger et al., commonly assigned with the present application, which is incorporated herein for all purposes. This patent shows a parallax correction device to ensure a golfer's head is properly positioned above a ball in putting. Another beneficial training device is shown in U.S. Patent Application Ser. No. 08/879,339, entitled "Detachable Training System for Golf Clubs" filed on Jun. 20, 1997, commonly assigned with the present application, which is incorporated herein for all purposes.

U.S. Pat. Nos. 5,388,831, and 5,207,429, to Quadri et al., and Walmsley et al, respectively, describe golf clubs which have light sources directly attached to the club shaft for aligning a club head with a ball. While these devices allow a golfer to align a club head along a target path, they do not help a golfer develop a correct pendulum swing. Because the light sources are directly coupled to the golf club, the golfer may still improperly swing. For example, the golfer is still able to improperly arc his swing as shown in FIG. 2A. Although an attached source can provide a good pointing reference to the golfer, such a configuration does not provide any positional reference to assist a golfer in developing a proper swing. Further, the light source attached to the club shaft changes the swing weight and feel of the club so that the golfer needs to readjust his swing when the laser source is removed. This reduces any beneficial training effect which may have been provided by the device.

There remains, therefore, a need for a training device and method which permits a golfer to develop a consistent stroke and pendulum swing. Preferably, the device should be portable and capable of being used indoors or outdoors to allow a golfer to practice the stroke in a variety of areas. The device and method should be capable of use without adding any attachments and undesirable weight to clubs a golfer would use in actual play.

SUMMARY OF THE INVENTION

Accordingly, a laser swing aid is described which is used for guiding a golf club head along a target path. The swing aid includes a body containing a power source coupled to a laser source coupled to an optics system. The optics system is arranged to produce a light beam in a plane. The body of the swing aid is positioned a distance apart from and separate from the club head and ball. The plane of the beam formed by the swing aid is positioned to produce a line of light aligned with the target path, the club head, and the ball.

In one embodiment, the laser swing aid is formed with a body adapted to be placed on a surface in front of or behind the golfer, for example, on a desk in an office, or on a bench outdoors.

In another embodiment, the laser swing aid has an attachment device for coupling with a pole or shaft, such as a pin on a golf course. In yet another embodiment the swing aid has a tripod base for placement in front of or behind a golfer.

Quite surprisingly, the result is a convenient and effective training aid which permits a golfer to perfect his swing during practice without having any training device attached to the club. The training aid may be used in a variety of locations, indoor or outdoor, allowing a golfer to practice almost anywhere.

A further understanding of features of the invention will be achieved by referring to the remainder of the specification and drawings.

DETAILED DESCRIPTION

Embodiments of the present invention will now be described by first referring to FIG. 1, where a laser swing aid 10 is shown for use with a golf club and ball in practicing and perfecting a correct pendulum swing (e.g., as shown and described in conjunction with FIG. 2B).

Figure 1:
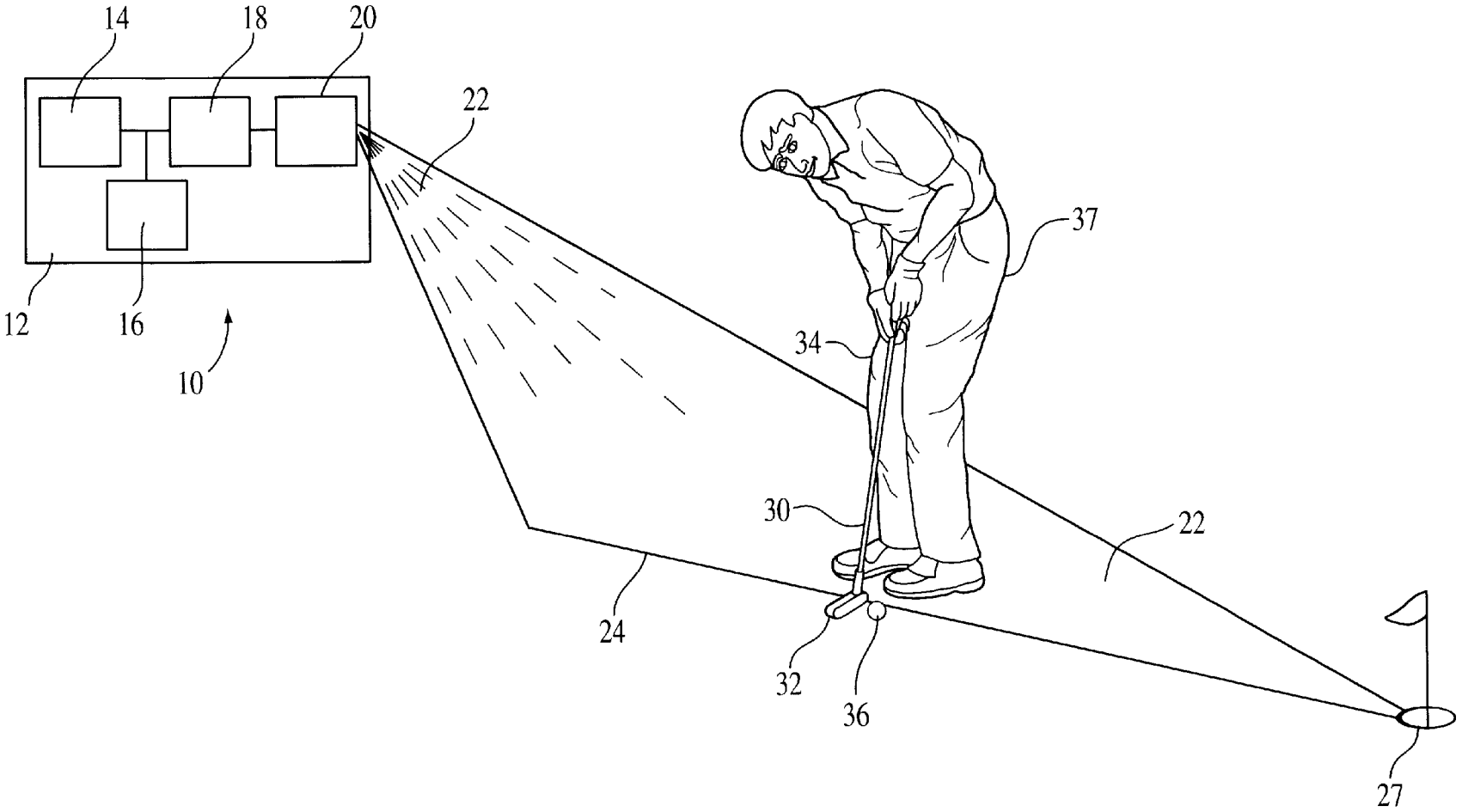
FIG. 1 is a block diagram of one embodiment of the laser swing aid of the present invention.
Figure 2B:
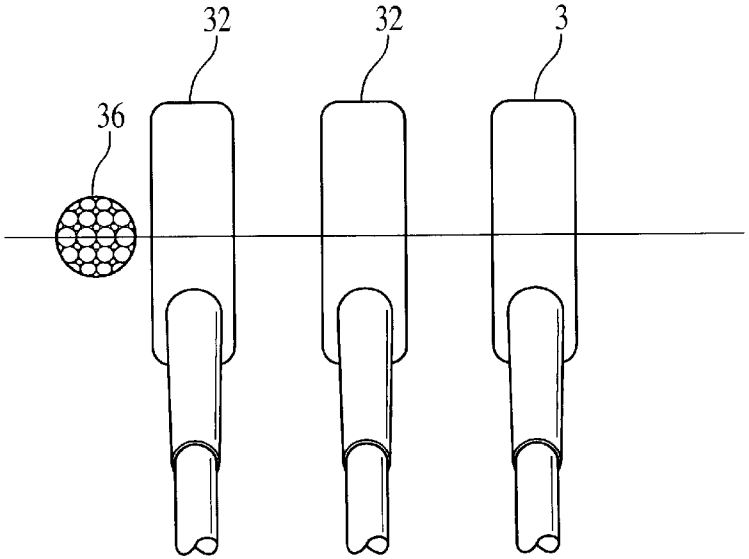
FIG. 2 is a top view of an improper swing (FIG. 2A) and a proper swing (FIG. 2B) attained using embodiments of the present invention.
Figure 2A:
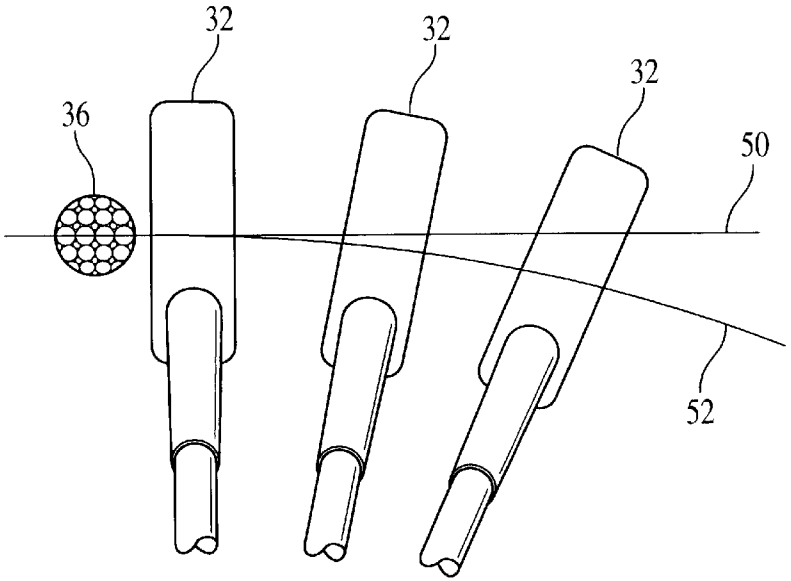

In the embodiment shown in FIG. 1, laser swing aid 10 includes a body portion 12, a power source 14, a switch device 16, a laser source 18, and an optics system 20. Laser swing aid 10 is operable to form a fan of light 22. Body portion 12 may be shaped in a number of ways to provide a conveniently placed or mounted training aid. For example, body portion 12 may be shaped as an ornamental statue or figurine which may be placed on a shelf or desk enabling the laser swing aid to be conveniently used in a golfer's home or office. For example, in a currently-preferred embodiment, body portion 12 is shaped as a pyramid which may sit on a flat surface to project a fan of light 22 across a practice surface, such as a floor or practice green. Body portion 12 may also be shaped as a cylinder or other shape which may be mounted in or on a golf bag or other object, or may include a tripod or other base for placement on a surface such as a putting green. Other shapes and configurations of body portion will be described herein.

In a currently-preferred embodiment, laser source 18 is a solid state semiconductor laser diode such as a laser diode emitting a coherent red light beam in a band of approximately 670 nm. Other laser sources may also be used so long as a visible wavelength is generated. The source and optics may also be configured to generate a number of colored lines or patterns rather than a single fan of light.

Preferably, the source is selected to consume relatively low amounts of power so that the swing aid may be powered by a long lasting internal power source 14. Further, the source may operate in different modes. For example, the source may be modulated in an on and off pulse-train mode, a repetitive sawtooth ramping mode, or a randomly fluctuating intensity mode, etc. By controlling the source's duty cycle, the laser swing aid 10 will be able to run with the same average power while reaching a much higher peak power. An increased peak power makes it easier for the human eye to detect the increased luminance during the interval the laser is on. Running in repetitious modes also allows for easier detection by the human eye. Modulating or strobing the beams may be used to generate images which may be used by the golfer to judge the velocity or speed of the ball or club head. Modulating the beams also ensures a longer life of the power source 14 by requiring less overall power. Further, the use of modulated pulses may also allow the use of a greater range of laser sources, including super bright light emitting diodes and filament or arc lamps.

Power source 14 may be, in one embodiment, one or more rechargeable or non-rechargeable dry cell batteries, such as a NiCad or the like. Those skilled in the art will also recognize that other types and sizes of batteries may also be used as a power source. Preferably, power source 14 is selected to provide a long lasting source of power to allow lasting use of swing aid 10 without needing to frequently replace the source.

Power to laser source 18 from power source 14 is switched using switch device 16, which may be, in an exemplary embodiment, a toggle switch or any other switch device known in the art, including voice or sound activated switch devices. Switch device 16 may also be configured to switch between source configurations in addition to switching the laser swing aid on and off. For example, a sound activated switch may be used to switch between beam types, such as between a fan of light at a first angle to a fan of light at a second angle. The switch device may also be used to change a pulse rate of the source, or the like.

Laser source 18 is optically coupled to optics system 20 to project fan of light 22. Optics system 20 may be formed from a cylindrical lens shaped to receive a beam of light from laser source 18 and convert it to a fan or line. A mirror may be placed either before or after the lens to turn or direct the fan of light as an output from laser swing aid 10. Other optics devices, known to those skilled in the art, may also be used to project and direct fan of light 22. For example, rotating or oscillating mirrors or lenses may be used to scan a beam into a fan. Alternatively, fan of light 22 may be produced by a grating, hologram, or other diffractive optic (reflective or transmissive). Optics may also be included to redistribute the energy in the fan. This can be necessary to put more energy in the more distant regions because the projected visible line is spread over a larger surface for a given angular portion of the fan of light 22. This redistribution may be accomplished in a variety of ways known to those skilled in the art, for example, with a custom refractive or custom diffractive optic.

In use, as shown in FIG. 1, a golfer 33 turns on laser swing aid 10 and directs fan of light 22 to create a visible line 24 towards a target 27. The golfer can then assume a position between laser swing aid 10 and target 27 to practice, e.g., putting. Visible line 24 acts as a source of reference to the golfer on axis to target 27. Because visible line 24 is formed from fan of light 22 extending along a plane, the line will be visible on objects in its path. For example, the line will be visible over the head of putter 32 and ball 36. The result is a training device which permits a golfer to practice and develop a proper pendulum swing (as shown in FIG. 2B). The golfer is able to develop a proper swing because the laser source is not coupled to the golf club. Instead, the source is a stationary reference for the golfer. The golfer is able to accurately monitor his or her back swing and forward swing by ensuring visible line 24 is always directly centered on the head of the club throughout the swing.

When contact is made with ball 36, the golfer can monitor the progress of the ball as well, by seeing if the ball deviates from the line. For example, if visible line 24 evenly divides ball 36 as it travels over a long distance, the golfer knows that putter head 32 was properly aligned and that the surface is flat. If visible line 24 evenly divides ball 36 over a shorter distance of ball travel, the golfer knows that putter head 32 was properly aligned and that the surface has some irregularities (e.g., the surface of the green had a "break" in it). Further, if ball 36 deviates from visible line 24 evenly (e.g., in a linear fashion with respect to time or distance), the golfer will be able to determine that putter head 32 was improperly aligned with ball 36. This information helps the golfer to develop a repeatable, accurate stroke as well as an ability to "read" surface irregularities in, e.g., a putting green.

Figure 3A:
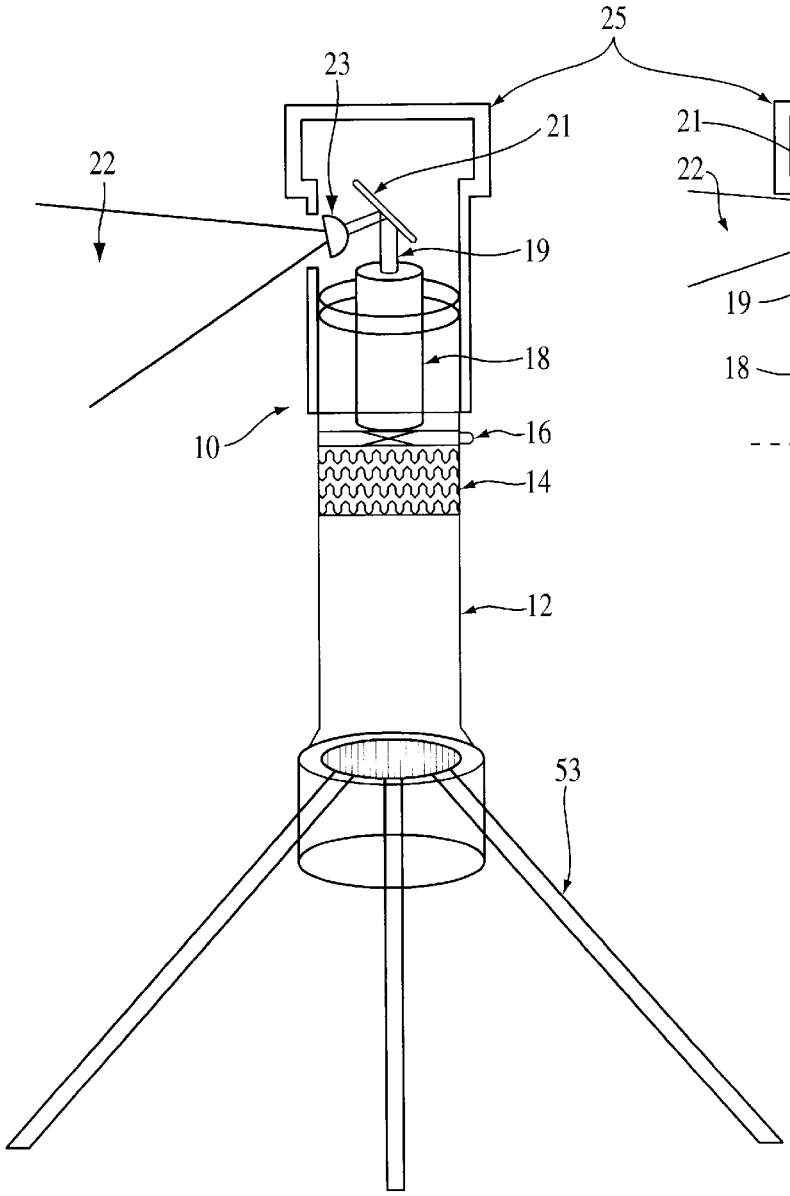
FIG. 3A is a perspective view of an alternative embodiment of a laser swing aid of the present invention and FIG. 3B is an alternative lens arrangement of the embodiment of FIG. 3A.
Figure 3B:
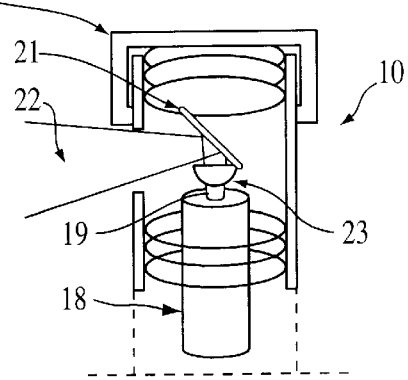

Another specific embodiment of laser swing aid 10 is shown in FIG. 3A. In this embodiment, laser swing aid 10 is formed from a cylindrical body 12 and is supported by legs 53. Swing aid 10 also includes power source 14, switch device 16, laser source 18 generating a beam 19. In the embodiment shown in FIG. 3A, optics system 20 is formed from a turning mirror 21 placed in front of a line generating optic 23. Alternatively, as shown in FIG. 3B, optics system 20 may be formed from a line generating optic 23 placed in front of a turning mirror 21. Both embodiments produce a fan of light 22 which may be used as a training aid as described above. Cylindrical body 12 may be capped with a removable top 25. Removable top 25 may be formed to contain optics system 20 and source 18 so that power source 14 is exposed when removable top 25 is removed. This allows ready replacement of, e.g., batteries, without disturbing the source or optics.

Legs 53 may be a tripod as shown or some other form of base to support laser swing aid 10. This embodiment is very lightweight and portable, and may be used in any location to practice using the training aid. For example, the aid may be placed on the ground on a putting green, or may be placed on a bench, or on a golf bag to allow practice outdoors.

Figure 4:
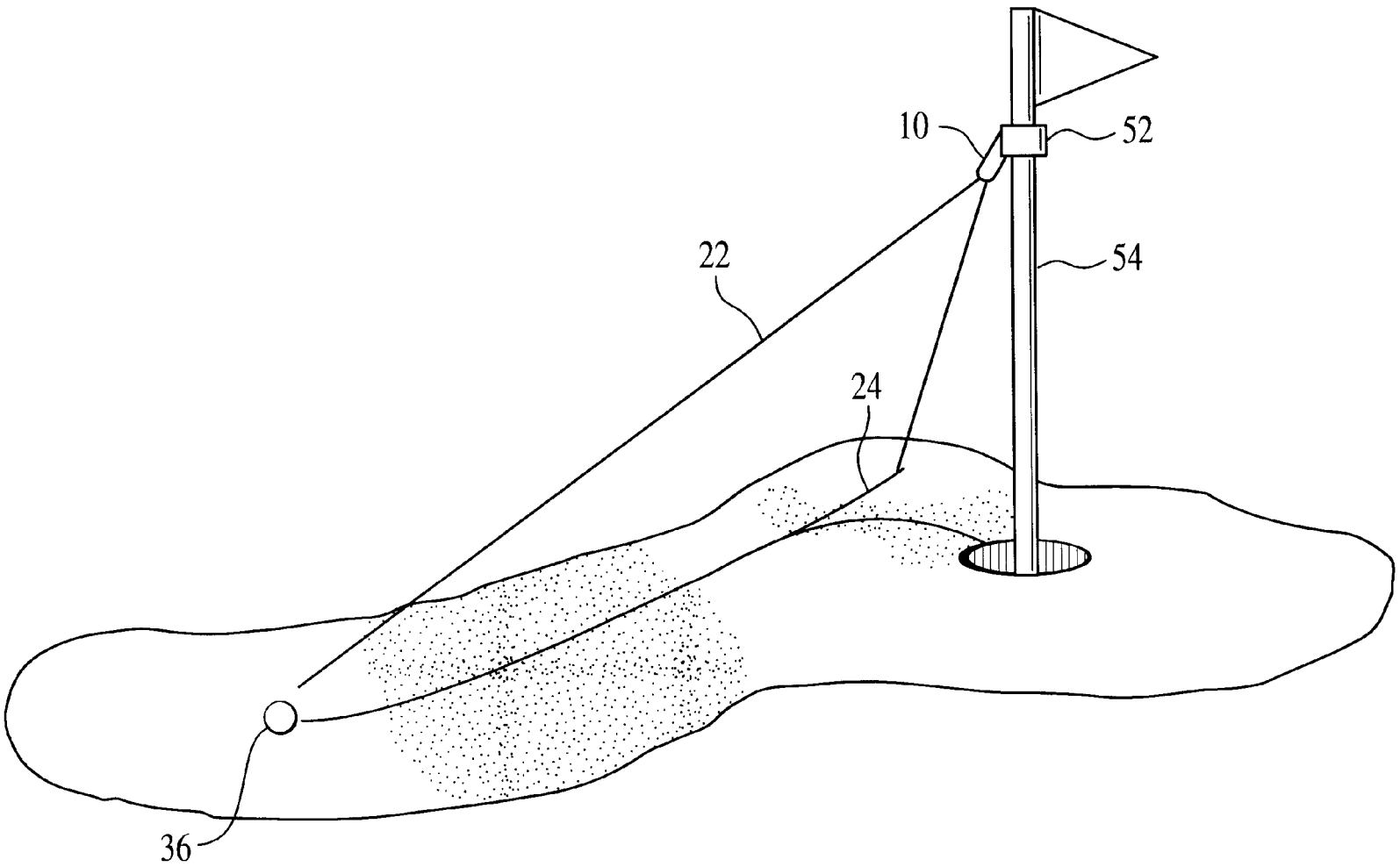
FIG. 4 is a perspective view of a further alternative embodiment of a laser swing aid of the present invention.

A further alternative embodiment is shown in FIG. 4 where laser swing aid 10 further includes a clamp device 52 allowing the swing aid to be mounted on a pole or post, such as a golf flag pin 54 or a golf club in a golf bag, etc. In an installation such as the one shown in FIG. 4, a golfer may use laser swing aid 10 on a practice putting green to practice his or her swing. A further advantage of use of swing aid 10 in this environment is that it helps a golfer read the green more accurately. Greens typically have slight deviations and slopes to make them more difficult. By watching the deviation of ball 36 from visible line 24, a golfer can learn to more accurately read these deviations and slopes and their affect on a balls trajectory.

Those skilled in the art, upon reading this disclosure, will recognize that the present invention may be embodied in other specific forms without departing from the spirit or essential characteristics thereof. For example, the laser swing aid may be used to practice other golf swings as well. For example, fan of light 22 may be tilted and positioned along a plane indicating a correct swing plane for, e.g., a driver or other golf club. A golfer may then monitor a swing by checking to ensure that the head of the, e.g., driver, is within the fan of light.

In another embodiment, two laser swing aids 10 may be positioned on in a plane along the target path; one in front of the golfer and one behind. This will serve to eliminate any shadowing of the fan of light behind, e.g., the club head or ball.

Accordingly, the disclosure of the specific embodiments of the invention are intended to be illustrative, but not limiting, of the scope of the invention which is set forth in the following claims.

We claim:

1. A method for practicing a golf swing, comprising the steps of:

positioning a laser swing aid a distance apart and separate from a golf club having a club head, the laser swing aid having a body portion enclosing an optics system;

operating said optics system to produce a fan of light along a plane;

aligning said plane to form a projected line of light along an intended target path;

positioning said club head of said golf club along said projected line of light; and positioning a ball in front of said club head along said projected line of light, said line of light providing a reference plane for correctly swinging said golf club to strike said ball, wherein said line of light is visible on both said club head and said ball throughout at least a portion of said golf swing.

2. The method of claim 1, further including the steps of:

positioning a second laser swing aid a distance apart and separate from said golf club having a club head;

operating said optics system to produce a fan of light along a plane; and aligning said plane to form a projected line of light along said intended target path and along said projected line of light formed by said first laser swing aid.

3. The method of claim 1, further including the step of operating said optics system to form a strobed beam of light.

4. The method of claim 3, further including the step of monitoring an image formed by said strobed beam of light to gauge a velocity of said ball.

5. The method of claim 1, further including the step of monitoring said projected line of light on said ball to analyze a golf stroke and a condition of a putting surface.

* * * * *